United States Patent [19]

Green

[11] Patent Number: 4,530,170

[45] Date of Patent: Jul. 23, 1985

[54] INSULATED VENT ADAPTOR

[76] Inventor: Morris J. Green, 224 S. New St., Exton, Pa. 19341

[21] Appl. No.: 624,279

[22] Filed: Jun. 25, 1984

[51] Int. Cl.[3] ..... F26B 11/04

[52] U.S. Cl. ..... 34/82; 34/86; 34/235

[58] Field of Search ..... 34/82, 86, 235; 138/89

[56] References Cited

U.S. PATENT DOCUMENTS

| | | | |
|---|---|---|---|
| 3,716,925 | 2/1973 | Hartung | 34/235 |
| 4,122,612 | 10/1978 | Mrofchak . | |
| 4,137,647 | 2/1979 | Clark, Jr. | 34/89 |
| 4,156,973 | 6/1979 | Bede . | |

*Primary Examiner*—Larry I. Schwartz

*Attorney, Agent, or Firm*—Steele, Gould & Fried

[57] ABSTRACT

A vent adaptor is disclosed which is suitable for attaching to the end of a dryer vent to connect the dryer vent to the building exterior through an existing wall opening. The vent adaptor includes a T-shaped hollow fitting which is fabricated with a vertical connector leg attachable to the end of the dryer vent and an intercommunicating hollow, horizontal conduit. The horizontal conduit includes a forward, insulating branch which forwardly terminates in a transition piece for frictional engagement within the building wall and a horizontally juxtaposed, rearwardly positioned storage branch in communication therewith. An insulating plug is reciprocal within the conduit from a storage position within the storage branch to an insulating position within the building opening whereby the building opening can be plugged when the dryer is not in use. A filter is removably secured in the storage branch interiorly of the storage plug in such a manner that warm, moist air from the dryer may be directed interiorly of the building through the filter when the insulating plug is reciprocated to its insulating position within the building wall opening.

10 Claims, 4 Drawing Figures

INSULATED VENT ADAPTOR

FIELD OF THE INVENTION

The present invention relates generally to the field of vents for home dryers, and more particularly, is directed to an insulating adaptor suitable to prevent the entrance of cold air at the dryer vent exhaust opening.

BACKGROUND OF THE INVENTION

It is the common practice to utilize a motor operated gas or electric dryer in or about a great number, if not the majority, of homes in the United States. Most of the dryers that are currently in use employ some type of heat producing means in conjunction with a rotary drum whereby the clothes or other articles to be dried can be tumbled in a heated environment to effect rapid drying. Because of the quantities of moisture and lint that are a necessary by-product of the drying operations, the present dryers are equipped with vents which extend from a portion of the dryer apparatus to the outside of the house or building. In this manner, the hot moisture and lint resulting from the dryer operation can be vented or exhausted outside of the building whereby these wastes will not interfere with the environmental conditions within the building.

Usually, a three inch or four inch galvanized steel, aluminum or plastic duct is installed between the dryer vent outlet and the outside wall to lead the moisture and lint products of the drying procedures as directly as possible exteriorly of the building. For this purpose, an opening or hole of suitable size and location is chiseled, drilled or otherwise provided through the building exterior wall and the vent or duct from the dryer is affixed directly to the building opening in a manner to exhaust the moist air and lint from the dryer directly exteriorly of the house. If desired, a hood or shield can be provided on the exterior wall about the opening to thereby protect the wall opening against the entrance of rain water, wind, etc.

While the existing designs and installations have proved entirely adequate and reliable in venting the hot moist air and the lint which results of the drying operations exteriorly from the building, the present construction inherently creates a heating problem by producing a substantially unrestricted and uninsulated opening between the interior of the building and the exterior of the building at the vent opening. Through this unprotected dryer vent opening, a considerable heat loss can be experienced when the dryer is not in operation, a condition which will function to create drafts and cold spots interiorly of the building adjacent to the wall opening. This unprotected opening results in increased costs of heating the residence due to the need to heat up the additional outside air that will enter the building through the unprotected opening. Sometimes the dryer vent opening is protected with a flap or damper to minimize the heat loss at the opening. However, experience has shown that such a damper is subject to clogging or other malfunction due to the lint and other materials present in the dryer effluent.

SUMMARY OF THE INVENTION

The present invention relates generally to household dryer vents, and more particularly, is directed to a vent adaptor which includes an insulating plug and operating means to provide an insulated closure for the vent opening in the building wall.

The vent adaptor of the present invention is generally T-shaped in configuration and includes a vertical connector leg of suitable dimensions and configuration to affix to a usual dryer vent in conventional manner. The connector leg terminates upwardly in a horizontal conduit which defines forwardly an insulating branch to guide an insulating plug into the previously unprotected opening. Preferably, the insulating branch forwardly carries a transition piece to facilitate attaching the vent adaptor to the existing dryer vent wall opening. The insulating branch is in fluid communication with a rearwardly positioned storage branch whereby a continuous, generally hollow, cylindrical conduit is formed by the adjacent insulating branch and storage branch.

The insulating plug is fabricated of suitable insulating material, such as styrofoam, fiberglass, etc., and is a sliding fit within the horizontal conduit defined by the storage branch and insulating branch. The insulating plug is movable from a storage position within the storage branch through the insulating branch to a forward position wherein at least a large portion of the insulating plug is positioned and maintained directly within the building wall opening.

The insulating plug may be horizontally reciprocated within the insulating branch and storage branch by employing an elongated handle, which handle can preferably be pivotally arranged in the interest of saving space. If desired, a usual filter may be mounted in the storage branch rearwardly of the rearward position of the insulating plug to trap any lint that may tend to enter the building through the adaptor. When the dryer is in operation, the handle is utilized to pull the insulating plug rearwardly into the storage branch for storage purposes to thereby permit the escape of the dryer effluent directly through the connector leg, through the insulating branch and thence through the wall opening to the outside of the building. Following completion of the drying cycle, the operating handle can be utilized to push the insulating plug forwardly until the insulating plug completely fills the wall opening to thereby prevent the entrance of cold air into the building through the wall opening.

It is therefore an object of the present invention to provide an improved vent adaptor of the type set forth.

It is another object of the present invention to provide a novel vent adaptor which includes means to affix the adaptor to the end of a dryer duct, a horizontal conduit connected to the means to affix and including a rearward storage branch and a forward insulating branch, the insulating branch including a transition piece to affix the vent adaptor to the vent opening, and insulating means movable from a storage position within the storage branch to an insulating position within the wall opening to thereby prevent the entrance of cold air into the building through the vent opening.

It is another object of the present invention to provide a novel vent adaptor including means to protect the dryer vent wall opening against the enterance of cold air, means to connect the dryer vent to the wall opening the means to protect being movable relative to the means to affix between a sealing position when the dryer is not in use to a storage position when the dryer is being used, whereby the waste products of the dryer operation can be exhausted directly outside of the building.

It is another object of the present invention to provide a novel vent adaptor including a T-shaped conduit, one vertical portion of the T-shaped conduit being connected to the dryer vent and a horizontal portion of the conduit being connected to the building wall opening, an insulating plug reciprocal within horizontal portions of the conduit between an insulating position and a storage position and filter means provided in the conduit rearwardly of the insulating means to filter any effluent from the dryer operation which may be exhausted interiorly of the building.

It is another object of the present invention to provide a novel vent adaptor that is simple in design, easy in installation and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
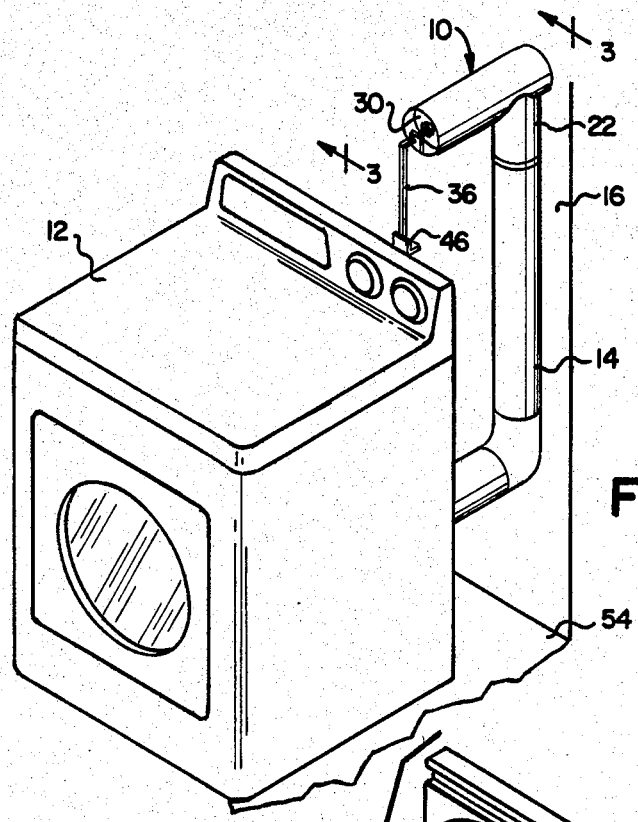
FIG. 1 is a perspective view showing the vent adaptor of the present invention in use in conjunction with a residential-type dryer.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 a conventional residential-type dryer 12 which includes a usual vent 14 which may be of galvanized steel, sheet aluminum, plastic or other approved suitable material of known construction. Such a vent normally terminates in an elbow (not shown) and is directly connected to an exhaust opening 18 in an exterior wall 16. In the present embodiment, the elbow has been removed and replaced with the vent adaptor 10 of the present invention. As illustrated, the vent 14 terminates upwardly in the new vent adaptor 10 to lead the products of dryer operation from interiorly of the building 54 through an opening 18 provided in the building exterior wall 16 to the exterior 56. See FIGS. 3 and 4.

Figure 2:
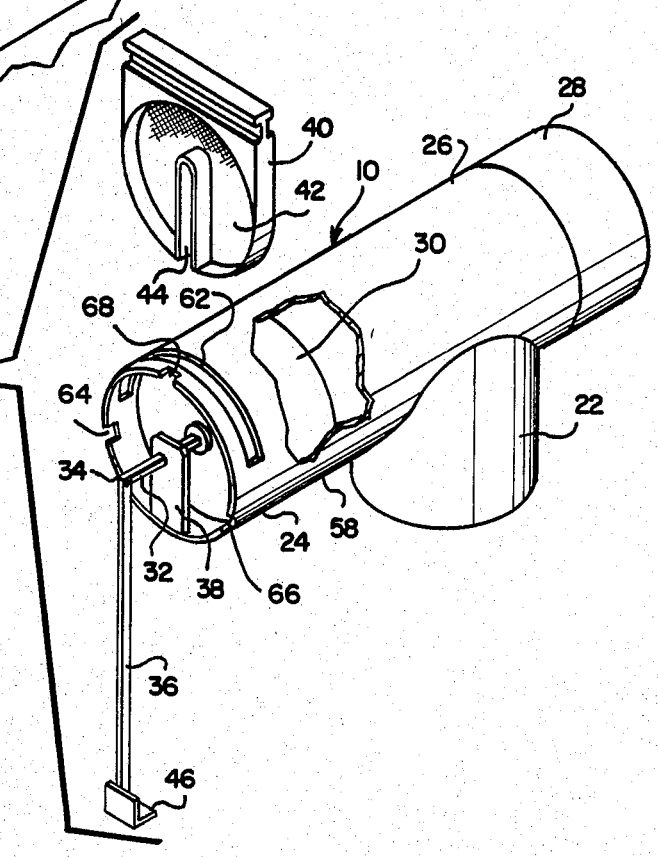
FIG. 2 is an enlarged, perspective view of the vent adaptor illustrated in FIG. 1, and partially broken away to expose interior construction features.

As shown in FIG. 2, the vent adaptor 10 is generally T-shaped in configuration and includes a hollow, vertical connector leg 22 and an innercommunicating horizontal conduit 58, which conduit includes a forward, insulating branch 26 and a communicating, rearwardly juxtaposed, storage branch 24. While the connector leg 22 is illustrated in vertical orientation, it will be appreciated that the connector leg would be otherwise oriented, for example, horizontally, as may be required to connect the dryer vent 14 to the vent adaptor 10. Both the storage branch 24 and insulating branch 26 of the conduit 58 are in fluid communication with the interior of the connector leg 22. As illustrated, the insulating branch 26 terminates forwardly in a conventional transition piece 28, which transition piece is configured to secure the vent adaptor 10 to the building wall 16 by frictionally engaging the peripheral walls 60 of the wall opening 18 in the usual manner.

Figure 3:
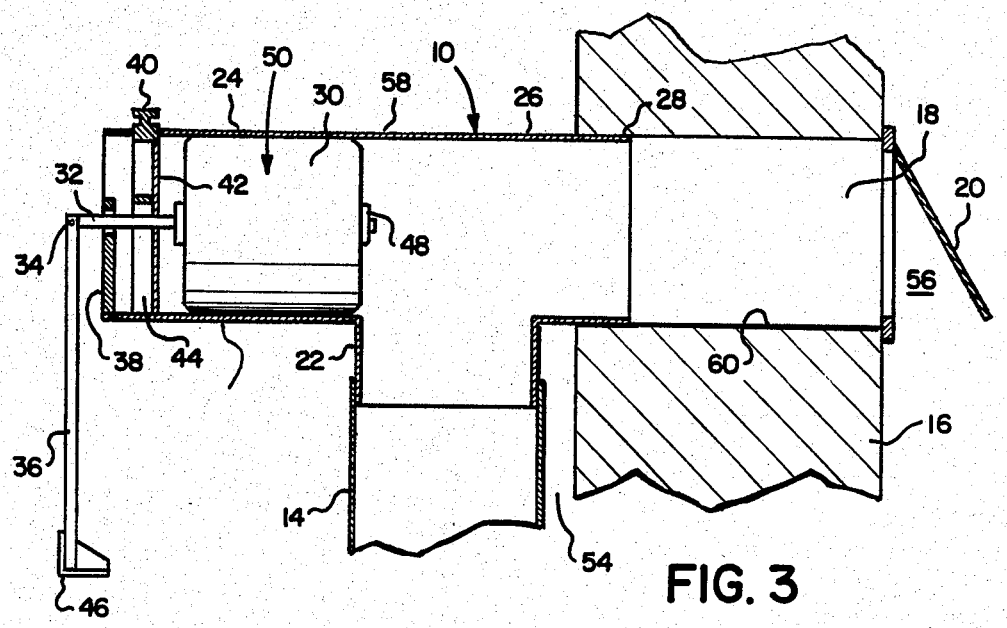
FIG. 3 is an enlarged, cross-sectional view taken along line 3—3 on FIG. 1, and showing the insulating plug in the storage position.
Figure 4:
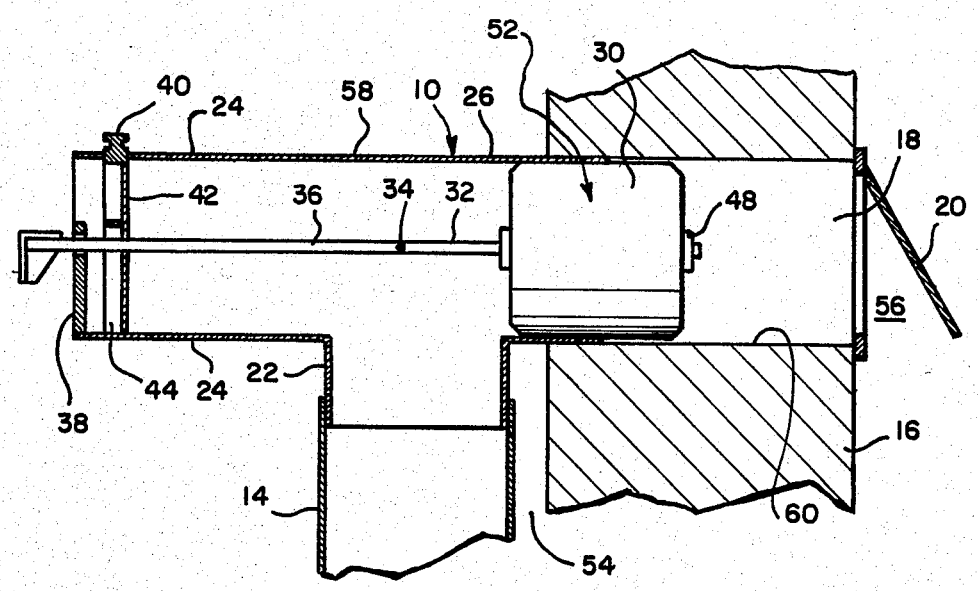
FIG. 4 is an enlarged, cross-sectional view similar to FIG. 3 and showing the insulating plug in the insulating position.

An insulating plug 30 of generally solid, cylindrical configuration complementary to the cross sectional configuration of the horizontal conduit is reciprocal within the horizontal conduit 58 between an insulating position 52 within the building wall opening 18, as illustrated in FIG. 4 and a storage position 50 within the storage branch 24, as illustrated in FIG. 3. In a preferred embodiment, a push rod 32 inserts through the insulating plug 30 and may be retained therethrough in a usual manner, for example, by employing an endward washer 48 or other construction. The push rod 32 is a sliding fit within a storage branch supported bracket 38 in manner to facilitate horizontal reciprocation of the insulating plug 30 between its storage and insulating positions 50, 52. In the illustrated embodiment, the push rod 32 terminates rearwardly in a pivot or hinge 34 and is pivotally connected to an elongated operating handle 36. The handle terminates at its downward end in a conventional grip 46 to facilitate operation of the insulating plug when employing the operating handle 36.

As illustrated in FIGS. 1 and 3, when the dryer is in operation, the push rod 32 and the affixed insulating plug 30 can be pulled rearwardly to the storage position 50 whereby the operating handle 36 will pivot naturally about the hinge 34 by gravity in a manner to position substantially parallel to the exterior wall 16 and thus provide an unobtrusive and space saving construction. When the dryer 12 is not in operation and it is desired to plug or insulate the wall opening 18, to prevent the entrance of cold outside air into the building interior 54, the handle 36 can be rotated upwardly about the pivot 34 by grasping the hand grip 46 to urge the operating handle 36 into longitudinal alignment with the push rod 32. With the parts thus positioned, by pushing forwardly on the hand grip 46, the insulating plug 30 can be easily pushed through the conduit 58 from the storage position 50 as illustrated in FIG. 3 to the insulating position 52 as illustrated in FIG. 4. In this position, the insulating plug 30 will completely fill the wall opening 18 and thereby prevent the entrance of cold air from outside 56 of the building to the interior 54.

In a preferred embodiment, the storage branch 24 may be provided with a rearward semi-circular top opening 62 to receive therein in a conventional manner a filter holder 40 of usual construction. The filter holder may be fabricated of plastic or other suitable material and is configured to support a filter screen 42 in a manner to screen or filter all effluent from the storage branch 24 which may tend to enter the building interior 54 through the storage branch 24. In a conventional manner, the filter holder 40 can be provided with a radially oriented, downwardly open slot 44 to facilitate positioning the filter 40 within the opening 62 and about the push rod 32.

When the insulating plug 30 is pulled to its storage position 50 within the storage branch 24 as illustrated in FIG. 3, the effluent from the dryer 12 will be directed through the dryer vent 14, through the connector leg 22 and thence outwardly of the building through the insulating branch 26, through the transition piece 28 to exit through the building wall opening 18. If desired, a deflector or hood 20 with or without a flap may be mounted exteriorly of the wall 16 in a known manner to prevent the entrance of rain water into the building interior 54 through the wall opening 18.

In the manner illustrated in FIG. 4, when the operating handle 36 is pivoted to its aligned position with the push rod 32, and the operating handle 36 is pushed forwardly through the opening in the bracket 38 to urge the insulating plug 30 forwardly, the insulating plug will be pushed to its insulating position 52 within the wall opening 18 to thereby prevent the entrance of cold air through the wall opening 18. In this position, should the dryer 12 then be operated either intentionally or unintentionally, the plug 30 will prevent direct exhaust to the outside and the dryer effluent will be directed through the dryer vent 14, upwardly through the connector leg 22 and thence rearwardly through the storage branch 24 to impinge upon the filter screen 42. Any lint (not shown) which may be contained in the dryer effluent will be trapped in the filter screen 42 in a usual manner. The filtered, hot, moist air from the dryer effluent will then be discharged to the building interior 54. Under certain conditions, this interior discharge may be desirable since the heat content of the dryer exhaust could be utilized for home heating purposes.

In the preferred embodiment as shown in FIG. 2, the rear surface of the storage branch 24 can be provided with one or more rearwardly open notches 64, 66, 68 of size and location to receive and retain therein a medial portion of the operating handle 36. In this manner, the operating handle can be conveniently placed in an unobtrusive position during the drying cycle when exterior venting is desired.

Although the invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A vent adaptor for connecting the vent of a dryer to an opening provided in a building exterior wall to discharge the dryer effluent comprising a hollow fitting having a connector leg affixed to the dryer vent in a substantially leak-proof junction and a conduit in fluid communication with the connector leg, the conduit comprising a storage branch, an insulating branch and a connector to connect the fitting to the building exterior wall at the said opening thereof;

insulating plug means reciprocal within the conduit between a storage position and an insulating position, at least a portion of the insulating plug means being positioned within the said wall opening when in the said insulating position to prevent the entrance of cold outside air into the building through the wall opening and at least a portion of the insulating means being positioned within the storage branch when in the said storage position to allow the passage of the dryer effluent through the wall opening; and operating handle means connected to the insulating plug means to reciprocate the insulating means between its said insulating and storage positions.

2. The vent adaptor of claim 1 wherein the operating handle means is axially aligned with the conduit and includes a push rod in contact with the insulating plug means and an operating handle connected to the push rod.

3. The vent adaptor of claim 2 and a pivotal junction interconnecting the push rod and the operating handle the push rod being shorter in length than the length of the storage branch and the combined length of the push rod and operating handly being at least as great as the length of the conduit.

4. The vent adaptor of claim 3 wherein the storage branch is provided with at least one rearwardly open notch, the notch being of suitable size and configuration to receive and releasably retain a portion of the operating handle.

5. The vent adaptor of claim 1 and a filter positioned in the storage branch interiorly of the insulating plug means.

6. The vent adaptor of claim 5 wherein a direct flow path through the exterior wall opening to the exterior of the building for the dryer effluent is formed from the dryer vent, through the connector leg and through the insulating branch to the wall opening when the insulating plug means is moved to its said storage position.

7. The vent adaptor of claim 6 wherein a direct path to the inside of the building for the dryer effluent is formed from the dryer vent through the connector leg, through a portion of the insulating branch, through the storage branch and through the filter when the insulating plug means is moved to its said insulating position within the wall opening.

8. The vent adaptor of claim 1 wherein the insulating means comprises a styrofoam plug.

9. The vent adaptor of claim 8 wherein the connector leg and the conduit are arranged at substantially right angles to form a generally T-shaped fitting.

10. The vent adaptor of claim 9 wherein the connector leg is vertical and the conduit is horizontal.

* * * * *